US005687887A

United States Patent [19]

Bond et al.

[11] Patent Number: 5,687,887

[45] Date of Patent: Nov. 18, 1997

[54] SIDE SIZER SYSTEM

[75] Inventors: Steve Bond, St. James; Gregory Anthony Montalbano, Greatneck, both of N.Y.

[73] Assignee: Red Wing Products, Inc., Plainview, N.Y.

[21] Appl. No.: 556,219

[22] Filed: Nov. 9, 1995

[51] Int. Cl.[6] ..... A47G 25/14

[52] U.S. Cl. ..... 223/85; 40/322

[58] Field of Search ..... 223/85, 92; D6/315; 40/322

[56] References Cited

U.S. PATENT DOCUMENTS

| | | | |
|---|---|---|---|
| 4,997,114 | 3/1991 | Petrou | 223/85 |
| 5,096,101 | 3/1992 | Norman et al. | 223/85 |
| 5,305,933 | 4/1994 | Zuckerman | 223/85 |
| 5,441,182 | 8/1995 | Sullivan | 223/85 |
| 5,449,099 | 9/1995 | Blanchard | 223/85 |

*Primary Examiner*—Bibhu Mohanty
*Attorney, Agent, or Firm*—McAulay Fisher Nissen Goldberg & Kiel, LLP

[57] ABSTRACT

The side sizer system includes a marker which can be mounted on a hanger in a self-locking manner. In some embodiments, the marker is fitted over an integral rib located at a juncture between a hook and the hanger body so as to engage under the rib in a self-locking relationship. In other embodiments, the hanger is provided with inwardly directed projections while the marker is provided with outwardly directed flanges to snap under the projections. In still other embodiments, the markers are provided with internal tabs with projections for snap-fitting into recesses in upstanding walls of mounting blocks on the hanger. Two types of tools for engaging under the markers to pull the markers from the ribs include jaws for splaying the marker walls outwardly.

25 Claims, 7 Drawing Sheets

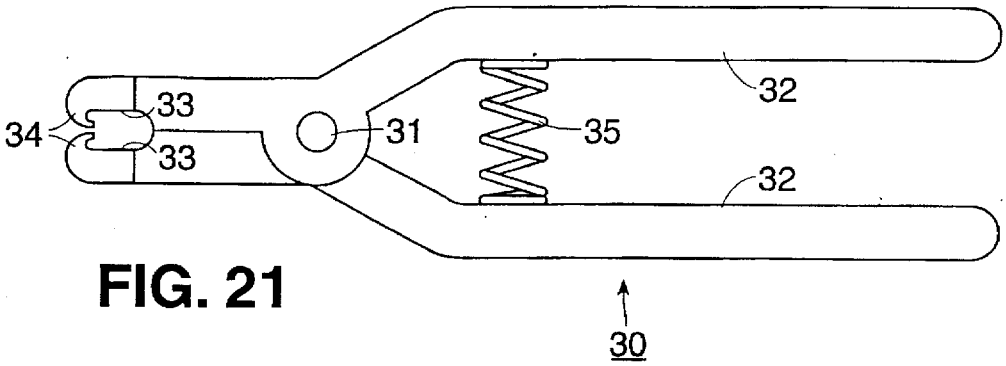
FIG. 21
FIG. 22
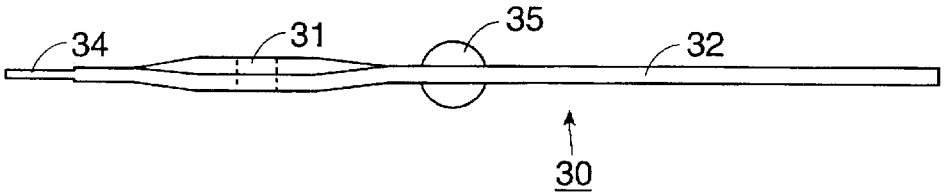
FIG. 23
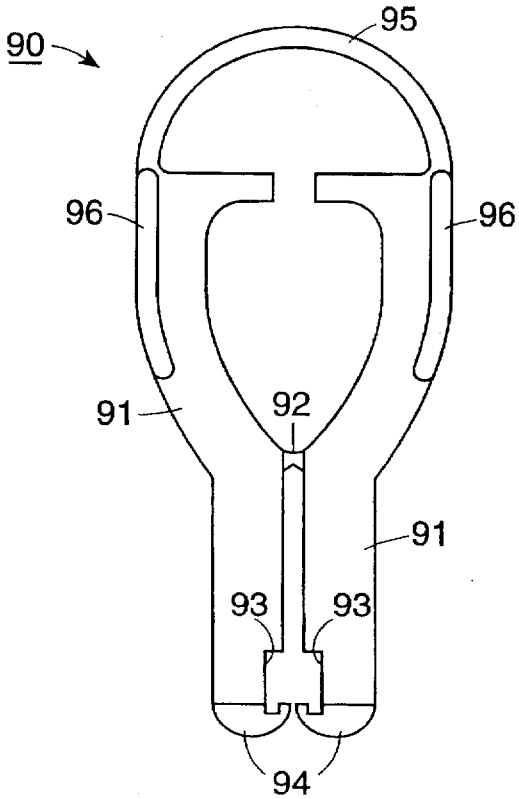
FIG. 24
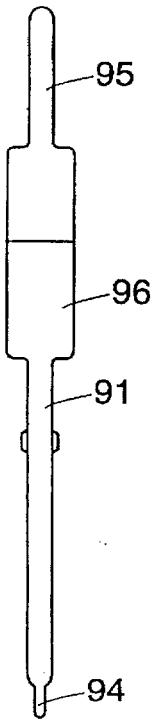

SIDE SIZER SYSTEM

This invention relates to a side sizer system. More particularly, this invention relates to a side mounted size marker for a hanger.

As is known, various types of markers have been provided for garment hangers in order to indicate the size of a garment suspended from the hanger. For example, U.S. Pat. No. 4,115,940 describes a size indicator which is mounted on a mounting member extending between a hanger body and a hook of the hanger. The marker is itself of a generally U-shaped cross-section so as to fit over the mounting member of the hanger. In addition, internal ribs have been provided on the marker to engage under an enlarged head or bead on the mounting member so as to retain the marker in place. However, such markers can be readily removed from the hangers and are not particularly suitable for present day needs for a child-resistant mounting arrangement.

U.S. Pat. Nos. 5,096,101, 5,199,608, 5,305,933 and 5,383,583 describe markers which can be mounted on hangers at the nexus between a hanger body and a hook so as to be permanently secured in place. Such markers are intended to be child-resistant. That is, the markers are permanently mounted on the hangers and cannot be readily removed without destroying the markers.

At the present time, as retail apparel chains seek to receive garments in a "floor ready" state, that is, hung on a hanger that is to be used to display the garments on the traditional hang-rails and the more modern face-out fixtures, there will be an increased demand for garment hangers that feature a highly visible size marker and a size marker that will be attached to the hanger by the garment manufacturer prior to shipment. By having a size marker in place on the hanger, the retailer will more easily and more efficiently be able to organize distribution to stores and departmental presentation on a selling floor. In addition, by controlling the sizer-system on the hangers, the retailer can control the quality and uniformity of the hangers on the selling floor. Further, the shipment of hangers by manufacturers without the specified sizer-system can be easily spotted and rejected thus, insuring control over the garment-on-hanger program.

A further requirement of retail apparel chains is that the size markers on a hanger be removable from time-to-time in order to permit recycling of the hangers. In this respect, after a garment has been sold, the hanger may be recycled so as to receive another garment of the same size. In the alternative, there may be a need to use the hanger for a garment of a different size. In such cases, there is a need to remove the size marker for replacement by a size marker indicating the correct size for the garment which is to be suspended from the hanger.

Accordingly, it is an object of the invention to improve upon the side- of-the-hanger sizer markers.

It is another object of the invention to provide a side size marker for a hanger which can be firmly mounted in place without rocking.

It is another object of the invention to provide a side size marker for a hanger which can be mounted on a hanger in a fixed manner and cannot be removed by hand and which requires a special tool for removal.

It is another object of the invention to provide a highly visible size marker on a hanger.

It is another object of the invention to provide a size marker which can be mounted on a hanger in a child-resistant manner.

Briefly, the invention provides a size marker for a hanger having a body for suspending a garment therefrom and a hook for suspending the body from a support. In addition, the hanger has a marker mounting means located at a juncture between the hanger and the hook. This mounting means includes a rib which extends angularly between the hook and the body with a gap disposed under a bottom of the rib. The rib is also provided with at least one longitudinal groove in each of two opposite sides.

The size marker is constructed so as to be mounted in self-locking relation on the rib of the marker mounting means. In this respect, the marker is made of plastic with a U-shaped cross-section so as to have a pair of parallel spaced apart walls receiving the rib of the mounting means therebetween as well as at least a pair of inwardly directed flanges on each parallel wall. The lower one of the flanges on each wall is disposed to pass into the gap under the rib, that is, to engage under the rib. In this way, the lower flanges serve to maintain the size marker mounted on the rib. The upper flanges on each parallel wall are respectively disposed in a respective groove in the rib in order to further secure the size marker to the rib.

The size marker also has a cover connecting the parallel walls in order to define a U-shaped cross-section.

When the marker is to be mounted on the hanger, the marker is simply pushed down over the rib. At this time, the lower flanges of the marker engage the rib and force the walls of the marker to splay outwardly so that the flanges may pass about the rib. In similar fashion, the upper internal flanges of the marker also engage with the rib and cause the side walls to splay outwardly as these flanges slide along the sides of the rib. Once the lowermost flanges pass beyond the rib and the upper flanges align with the longitudinal grooves, the walls of the marker spring together so that the lower flanges snap into place below the rib, that is, into the gap defined below the bottom of the rib. At the same time, the upper flanges spring into the longitudinal grooves in the sides of the rib. The marker is thus locked onto the rib in a self-locking relationship.

The marker mounting means also includes a pair of transverse parallel walls having the rib extending therebetween. In addition, the marker is of a length to slidably fit between these parallel walls. In this respect, the marker is of a length to substantially completely fill the space between the two parallel walls of the marker mounting means so as to be received in a flush condition. In addition, the marker has a cross-sectional contour which is smaller than each of the parallel walls so as to be recessed therein. In this respect, each of the parallel walls forms a "bead" to preclude removal of the marker by any means other than a special tool.

The hanger may be of a type having a plastic post integral with the body while the hook is made of metal and is received in the post. In such a hanger, the mounting means extends between the post and the hanger body. In alternative constructions, such as where the hanger body and hook are molded in one piece of plastic, the marker mounting means is located between the hook and the hanger body.

In one embodiment, the size marker may have a third inwardly directed flange on each wall to face the wall of the rib. These additional flanges serve to stabilize the marker on the rib against any rocking of the marker relative to the rib.

In another embodiment, each side wall of the rib is provided with a curvilinear contour while each wall of the marker has a curvilinear contour mating with a respective wall of the rib.

In each of the above embodiments, the mounting means is constructed to have a third wall or flange parallel to the rib on an opposite side of the gap. In this case, this wall is made to have a cross-sectional width wider than the marker when the marker is in place. In addition, the wall is provided with a pair of oppositely disposed slots or recesses which extend under the walls of the marker in order to permit engagement of a tool of predetermined design with the marker walls for removal of the marker from the rib. In this respect, the tool is constructed so as to have jaws to pass through the recesses in the flange and to engage with the interior of the marker. Upon movement of the jaws outwardly of each other, the walls of the marker splay outwardly thereby allowing the marker to be lifted off the rib in a reverse direction from the direction in which the marker was initially placed on the rib.

The tool for disengaging the marker from a hanger basically comprises a pair of arms mounted on a pivot for pivoting relative to each other between a closed position and an open position. In addition, each arm has a recess at one end to define a rectangular space with the recess of the opposite arm sized to receive the U-shaped marker therein. Each arm also has a hook-shaped jaw for engaging under a wall of the marker which is received in the space between the arms when the arms are in the closed position. A spring is also provided on an opposite side of the pivot from the jaws for biasing the arms into the closed position whereby upon pivoting of the arms to the open position, the hook-shaped jaws engage and deform the walls of the marker in an outward direction relative to the remainder of the marker.

In still another embodiment, the marker mounting means may be constructed with a plurality of upstanding inwardly directed hook-shaped projections which are disposed on opposite sides of and below the rib. In this embodiment, the size marker includes a pair of parallel walls for receiving the rib therebetween while being laterally disposed between the upstanding projections. Each marker wall also has a pair of outwardly directed flanges at the bottom to engage the projections of the mounting means. In this case, the lower flange on each marker wall is disposed inwardly of and in engagement with one of the hook-shaped projections of the mounting means while the upper flange is disposed over a respective one of the hook-shaped projections. In this respect, each hook-shaped projection mates with the two flanges of a wall of the marker.

In this embodiment, the gap which is defined in part by the rib is oversized so that the two walls of the marker can be squeezed together into the gap when the marker is slid into place on the rib. After being pressed inwardly to slide within the hook-shaped projections of the mounting means, the two walls are allowed to spring outwardly so as to engage with the hook-shaped projections of the hanger mounting means.

The construction of this embodiment is such that the hook-shaped projections are longitudinally spaced from each other on each side of the mounting means while being disposed in staggered relation with respect to the projections on the opposite side.

In order to remove the marker of this embodiment from a hanger, a force must be developed which is sufficient to squeeze the terminal ends of the walls together to a degree sufficient to disengage from the hook-shaped projections on the mounting means and to allow lifting of the marker from the rib. Typically, such a force would be more than that produced by a small child.

In still another embodiment, the hanger may be constructed with a marker mounting means which includes a plurality of upstanding walls disposed in spaced relation to a common plane and in alternating manner on opposite sides of the plane. In addition, at least one of the upstanding walls is provided with a recess facing the common plane. In this embodiment, the size marker includes a pair of parallel walls, as above, a cover which extends between the parallel walls and a tab which extends internally from the cover in the common plane located between the upstanding walls of the mounting means. This tab is provided with at least one projection for engaging in the recess in the wall of the mounting means. Thus, when the marker is fitted into place, the depending tab is located between the plurality of upstanding walls while the projection of the tab engages in a recess of the recessed wall. In this way, the marker is secured in a self-locking manner on the hanger.

The space between the upstanding walls of the mounting means to either side of the common plane passing between the walls is such that the depending tab of the size marker substantially occupies the space. In this way, with the projection on the tab engaged in a recess on one upstanding wall, the opposite side of the tab abuts against the walls on the opposite side of the plane between the upstanding walls.

In this embodiment, the depending tab may be provided with projections on opposite sides for engaging in mating recesses in upstanding walls on opposite sides of the common plane.

When the marker of this embodiment is being slid into place, the internal tab of the marker spreads the upper ends of the upstanding walls of the mounting means until the projection or projections on the tab snap into the recess or recesses of the upstanding walls. At this time, the upstanding walls snap back into a normal position thereby locking the marker in place on the hanger.

The marker of this embodiment is intended to be permanently secured to the hanger. That is, no special tool is provided for disengaging the marker from the hanger.

These and other objects and advantages of the invention will become more apparent from the following detailed description taken in conjunction with the accompanying drawings wherein:, FIG. 1 illustrates a partial view of a hanger and marker constructed in accordance with the invention;

FIG. 21 illustrates a view of a tool of predetermined construction in accordance with the invention for removing a marker from a hanger;

FIG. 22 illustrates a side view of the tool of FIG. 21;

FIG. 23 illustrates a side view of a further modified tool in accordance with the invention; and FIG. 24 illustrates a side view of the tool of FIG. 23.

Figure 1:
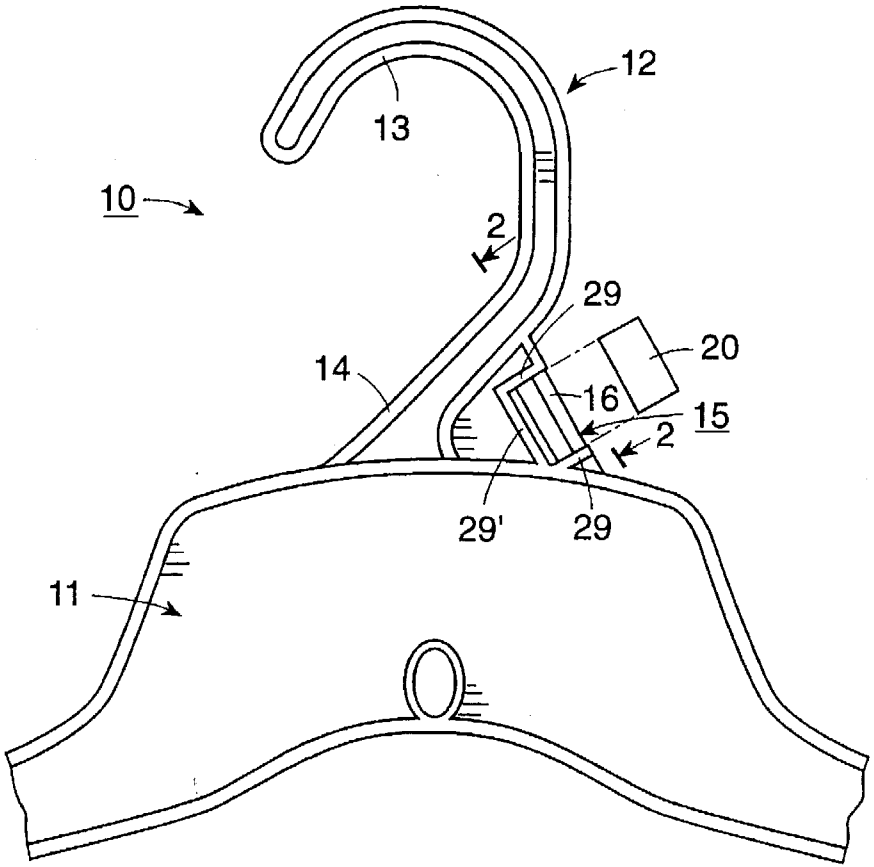

Referring to FIG. 1, a hanger 10, such as a plastic molded hanger includes a body 11 for mounting a garment thereon and a hook 12 extending from the body 11 in order to suspend the body 11 from a support (not shown). In addition, the hook 12 has a curved portion 13 at the upper end, and a curved portion 14 at the lower end which merges the hook 12 into the body 11. The hanger 10 also has a marker mounting means 15 located at a juncture between the hanger body 11 and the hook 12. This mounting means 15 includes a rib 16 extending angularly between the hook 12 and body 11 with a gap under the bottom of the rib 16. The term "gap" is meant to define a hole or opening, as in a wall or fence, made by breaking or parting, and not a recess.

Figure 2:
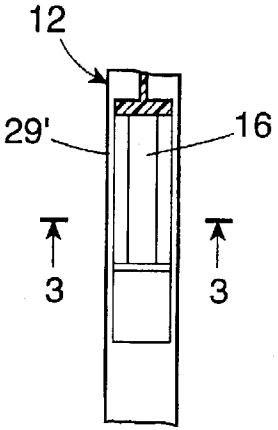
FIG. 2 illustrates a view taken on line 2—2 of FIG. 1.
Figure 3:
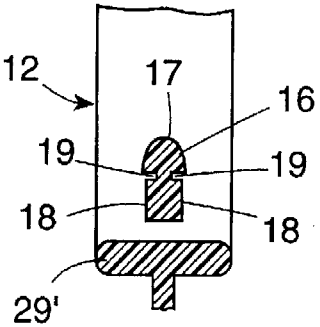
FIG. 3 illustrates a cross-sectional view of the rib of the hanger in accordance with the invention as taken on line 3—3 of FIG. 2.

Referring to FIGS. 2 and 3, the rib 16 is of generally rectangular cross-section with a rounded top 17 and flat side walls 18, each of which contains a longitudinal groove 19.

Figure 4:
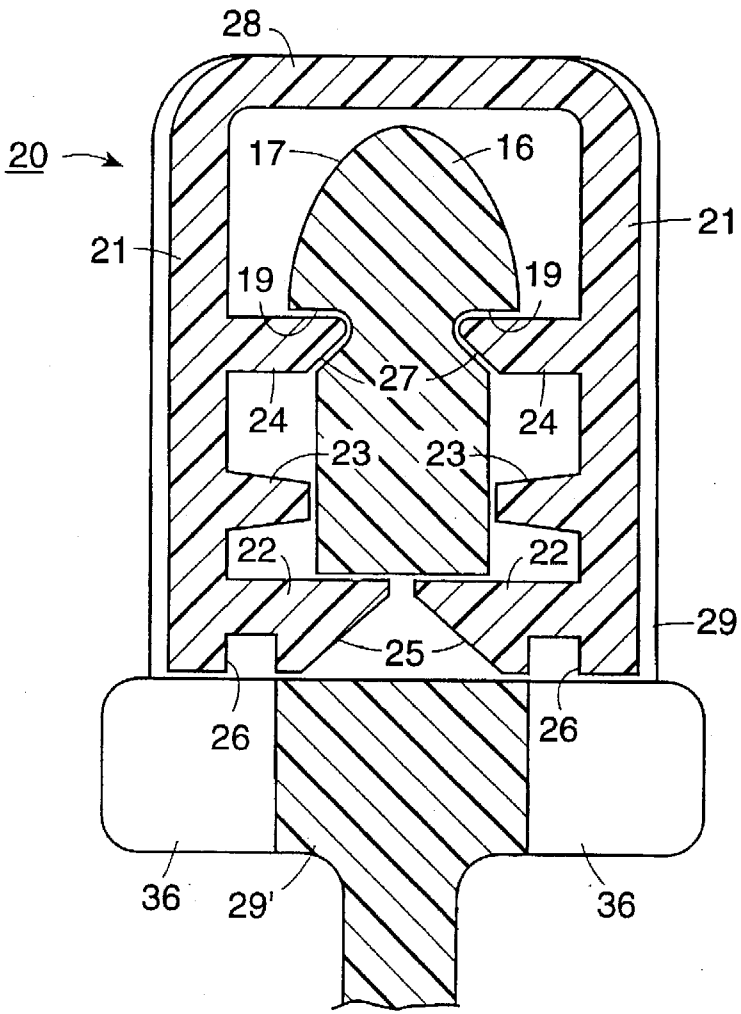
FIG. 4 illustrates a cross-sectional view of a modified marker and hanger rib in accordance with the invention.

Referring to FIG. 1, a marker 20 is mounted on and over the rib 16 in self-locking relation. As illustrated in FIG. 4, the marker 20 has a pair of spaced apart parallel walls 21 which receive the rib 16 therebetween. In addition, each wall 21 has three inwardly directed flanges 22, 23, 24. The lowermost flange 22 on each wall 21 is disposed perpendicularly of the wall 21 and is sized to extend into the gap under the bottom of the rib 16. As indicated, the lowermost flange 22 extends inwardly a greater distance than the other flanges 23, 24 on the wall 21. The spacing between the two opposed flanges 22 is also less than the thickness of the rib 16, e.g. being a minor fraction thereof. In this respect, each flange 22 has an inclined cam surface 25 for purposes as explained below as well as an downwardly facing recess 26 of rectangular shape.

The middle flange 23 on each wall 21 is directed inwardly towards a wall 18 of the rib 16 and has a flattened terminal surface formed into close-fitting relationship with the flat side wall 18 of the rib 16.

The uppermost flange 24 on each wall 21 extends inwardly a greater distance than the middle flange 23 and has an inclined surface 27 so that the cross-sectional shape of the end of the flange 24 mates with the cross-sectional shape of the longitudinal groove 19 in the rib 16.

In order to mount the marker 20 on the rib 16, the lowermost flanges 22 of the marker 20 are disposed on the rounded top 17 of the rib 16. A force is then impressed on the marker 20 so that the inclined surfaces 25 of the lowermost ribs 22 slide on the top 17 of the rib 16 thereby causing the walls 21 of the marker 20 to splay outwardly. Continued pressing of the marker 20 onto the rib 16 allows the lowermost flanges 22 to pass over the top 17 followed by passage of the internal flanges 23, 24 over the top 17. This motion continues until the upper flanges 24 snap into the longitudinal grooves 19 of the rib 16. At the same time, the walls 21 of the marker 20 move towards each other so that the lowermost flanges 22 slide under the rib 16, that is, into the gap. At this time, the marker 20 becomes locked to the rib 16.

As illustrated, the marker 20 is provided with a flat cover 28 which connects the parallel walls 21 together in order to define a U-shaped cross-section.

As shown in FIG. 1, the marker mounting means 15 includes a pair of parallel walls 29 having the rib 16 extending therebetween and a third wall 29' parallel to the rib 16 to define the gap therebetween. The marker 20 is of a length to slidably fit between the parallel walls 29 and has a cross-sectional width, as shown in FIG. 4, which is smaller than each parallel wall 29 to be recessed therein. The third wall or flange 29' is of a cross- sectional width wider than the width of the marker 20 so as to preclude the formation of any gaps or openings between the flange 29' and the side walls 21 of the marker 20. This serves to prevent insertion of a coin or the like between the marker 20 and the flange 29' for unauthorized removal of the marker 20.

Referring to FIGS. 21 and 22, a special tool 30 of predetermined design is provided for disengaging the marker 20 from the rib 16 of the hanger. As indicated, the tool 30 includes a pivot 31 and a pair of arms 32 which are mounted on the pivot 31 for pivoting relative to each other between a closed position, as viewed, and an open position. Each arm 32 has a recess 33 at one end to define a rectangular space with the recess 33 of the opposite arm. This rectangular space is of a size to receive the U-shaped marker 20 (see FIG. 4). Each arm 32 also has a hook-shaped jaw 34 at the terminal end for engaging under a wall 21 of the marker 20 which is received in the space between the jaws 33 when the arms 32 are in the closed position. As indicated in FIG. 22, each jaw 34 is of a thickness smaller than the remainder of the arm 31 from which the jaw 34 extends. The tool also has a coiled spring 35 on an opposite side of the pivot 31 from the jaws 34 for biasing the arms 32 into the closed position.

In order to remove the marker 20 from the rib 16, the flange 29' has a pair of oppositely disposed recesses or slots 36 (see FIG. 4) extending under the walls 21 of the marker 20 in order to permit engagement of the tool 30 with the marker walls 21. In this respect, the tool 30 is placed over the marker 20 so as to receive the marker 20 within the recesses 33 of the arms 32. At the same time, the hook-shaped jaws 34 pass through the slots 36 and fit into the rectangular recesses 26 of the flanges 22. A squeezing force is then placed upon the arms 32 against the bias of the spring 35 so as to cause the jaws 34 to move apart. At this time, the walls 21 of the marker splay outwardly thereby moving the flanges 22 from under the rib 16 while disengaging the uppermost flanges 24 from within the grooves 18 of the rib 16. The amount of outward movement of the side walls 21 is sufficient so as to permit the uppermost flanges 24 to be passed over or flexed over the top 17 of the rib 16 with continued upward movement of the tool 30 causing the marker 20 to be removed from the rib 16. A new marker may then be put in place with a different size indication thereon.

The walls 21 of the marker as well as the cover 28 are of a suitable size so as to permit indicia to be placed thereon indicative of the size of a garment suspended from the hanger 10.

The marker 20 is made of plastic or of any suitable material having sufficient resiliency or memory to return to an unstressed condition locking relation with the rib 16.

Figure 5:
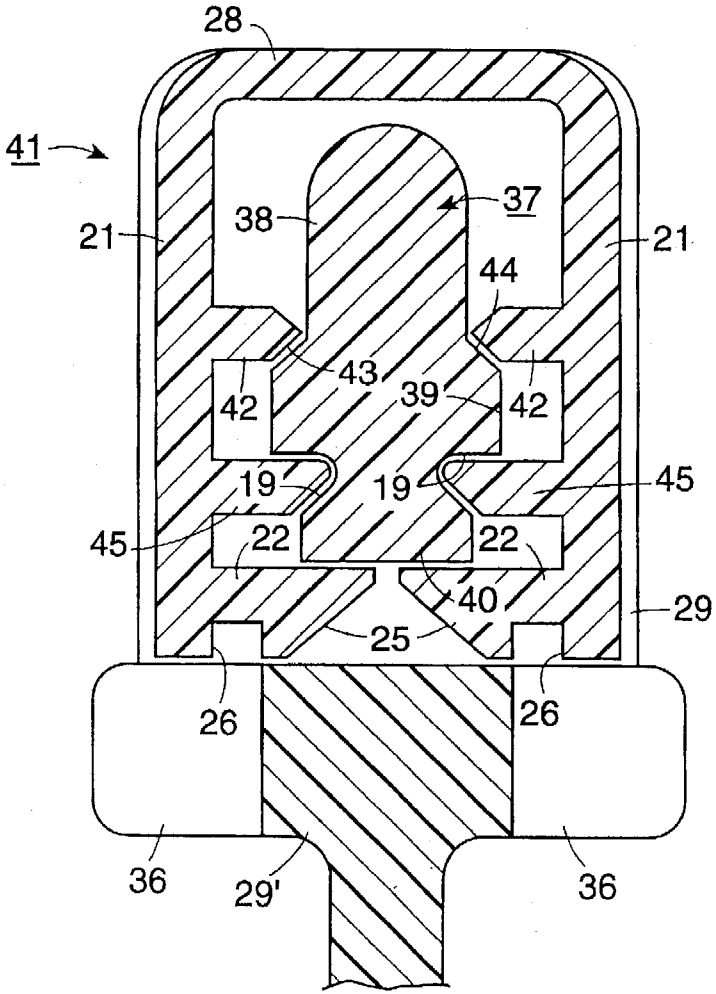
FIG. 5 illustrates a cross-sectional view of a further modified marker having three pairs of internal ribs.

Referring to FIG. 5, wherein like reference characters indicate like parts as above, the rib 37 of a hanger may be modified so as to have a cross-section with an upper section 38 of reduced width, an intermediate section 39 of enlarged width and a lower section 40 of a width less than the enlarged section 39. In this embodiment, a longitudinal groove 19 is provided in each side wall between the two lowermost sections 39, 40.

The marker 41 is provided with walls 21 as above with each wall 21 having a lowermost flange 22 as above. In addition, each wall 21 has an upper flange 42 provided with an inclined surface 43 at the terminal end for abutting against a sloped surface 44 on the enlarged portion 39 of the rib 37. In addition, each wall 21 is provided with an intermediate flange 45 which engages in a longitudinal groove 19 of the rib 37 in mating relation.

The marker 41 of FIG. 5 is mounted in place by pressing the lowermost flanges 22 of the marker against the top of the rib 37. These flanges 22 thus slide along the upper section 38 of the rib 37 to pass over the enlarged section 39. This is followed by passage of the intermediate flanges 45 over the sloped surfaces 44 of the enlarged section 39 until these flanges 45 snap into the grooves 19. At this time, the walls 21 of the marker move together so that the lowermost flanges 22 move into the gap below the rib 37 to form a self-locking connection with the rib 37. At the same time, the uppermost flanges 42 come into close fitting relationship or contact with the sloped surfaces 44 of the intermediate section of the rib 37.

Figure 8:
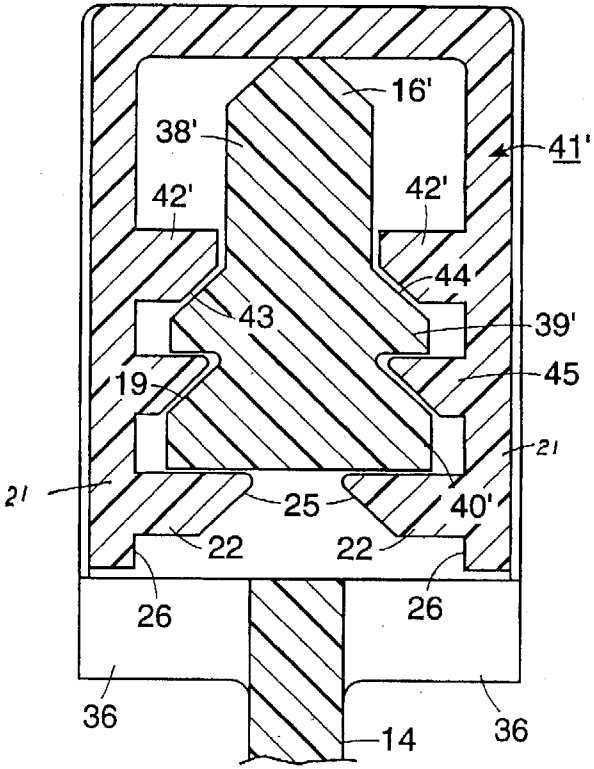
FIG. 8 illustrates a cross-sectional view taken on line 8—8 of FIG. 7.
Figure 6:
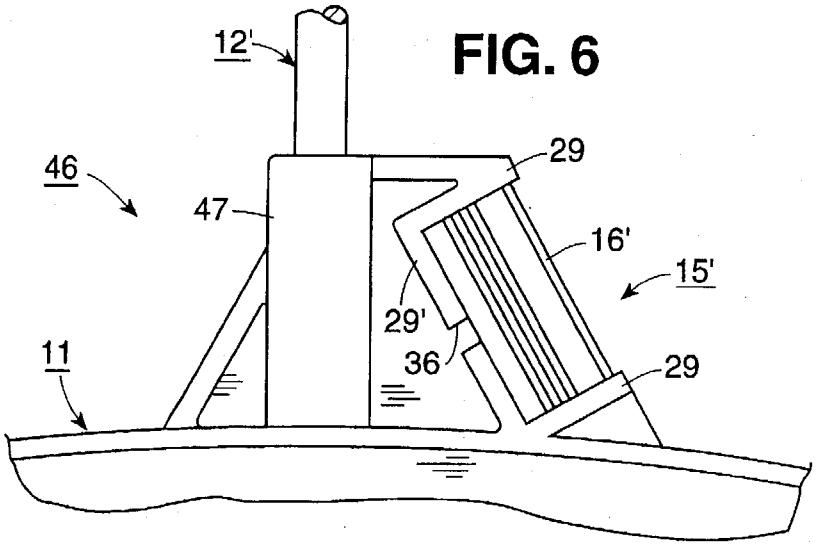
FIG. 6 illustrates a partial view of a hanger having a metal hook and a marker mounting means in accordance with the invention.
Figure 7:
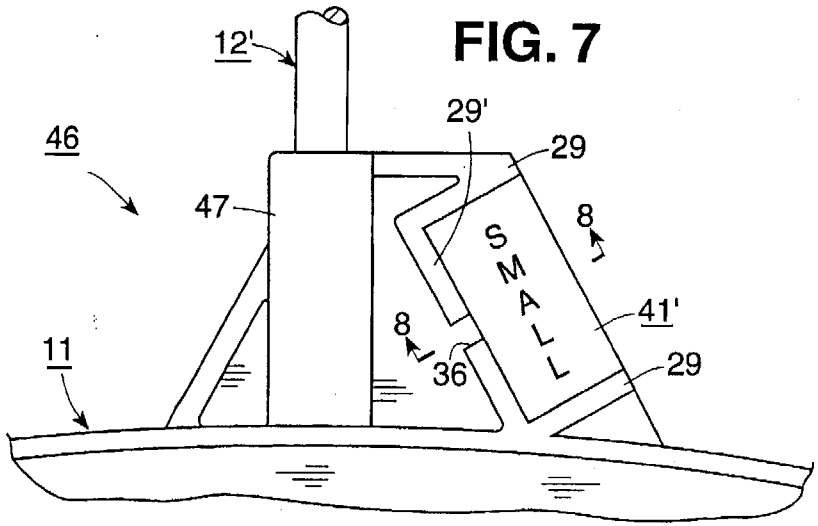
FIG. 7 illustrates a view similar to FIG. 6 with a marker in place in accordance with the invention.

Referring to FIGS. 6 to 8, wherein like reference characters indicate like parts as above, the hanger 46 has a body 11 of plastic which receives a hook 12' of metal. In this embodiment, the hanger 46 has a post 47 which is integral with the body 11 while the hook 12' is received within the post 47 in a conventional manner. In this case, the mounting means 15' extends between the post 47 and hanger body 11.

As indicated in FIGS. 6 and 8, the rib 16' of the marker mounting means 15' has a modified cross-sectional shape from that as described, for example in FIG. 5. In this respect, the rib 16' has an upper section 38' of reduced width with a flat top surface and inclined side surfaces extending from the flat top surface. In addition, the rib 16' has an intermediate section 39' of enlarged width and a lower section 40' of the same width as the enlarged intermediate section 39'. As above, a longitudinal groove 19 is provided in each side wall between the two lowermost sections 39', 40'.

The marker 41' is provided with two parallel walls 21, as above, with each wall 21 having a foremost flange 22. In addition, each wall 21 has an upper flange 42' provided with an inclined surface 43 for abutting against a sloped surface 44 on the enlarged section 39' of the rib 16'. Each wall 21 is also provided with an intermediate flange 45 which engages in the longitudinal groove 19 of the rib 16' in mating relation.

Figure 9:
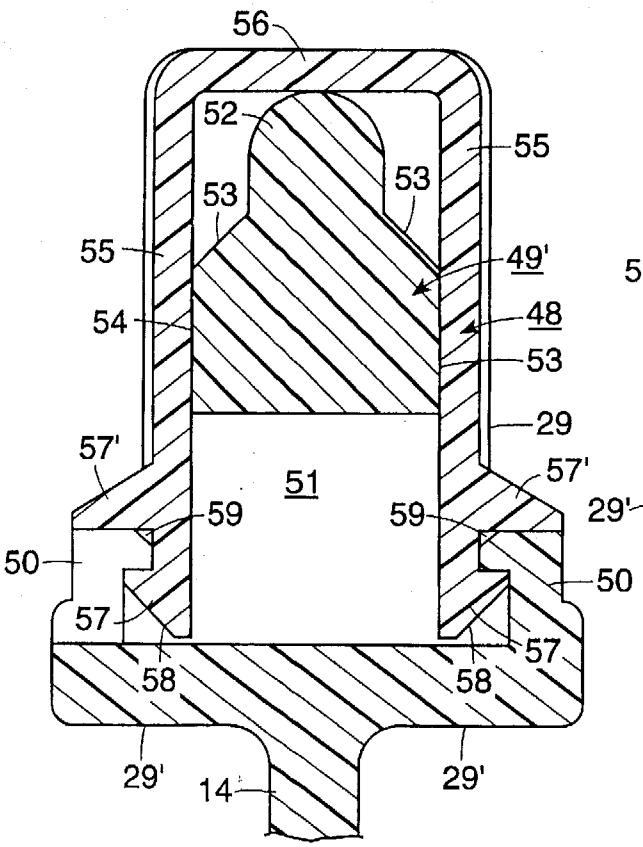
FIG. 9 illustrates a part cross-sectional view of a marker and hanger constructed in accordance with the invention with hook-shaped projections on the hanger for engaging with externally directed flanges on the marker.

Referring to FIG. 9, a size marker 48 may be constructed to snap into place over a rib 49 rather than locking onto a rib as in the above embodiments.

Figure 11:
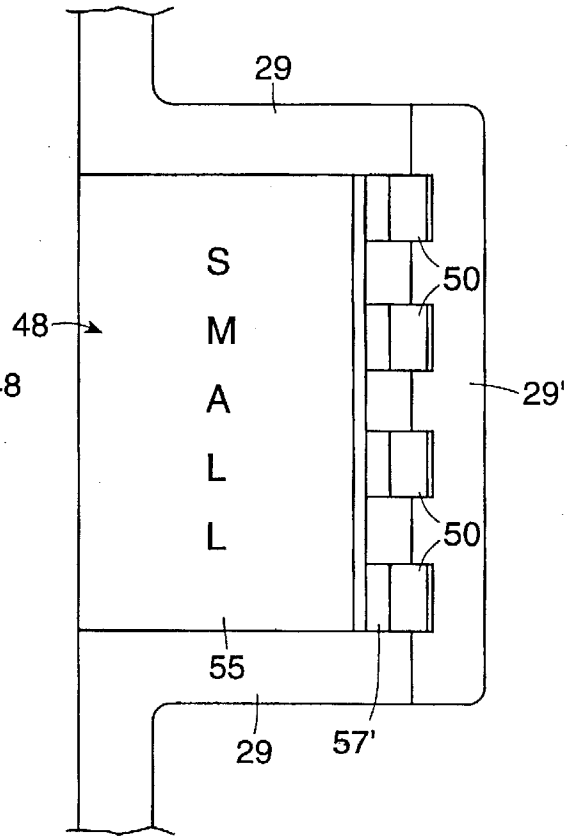
FIG. 11 illustrates an opposite side view of the marker and hanger of FIG. 9.
Figure 10:
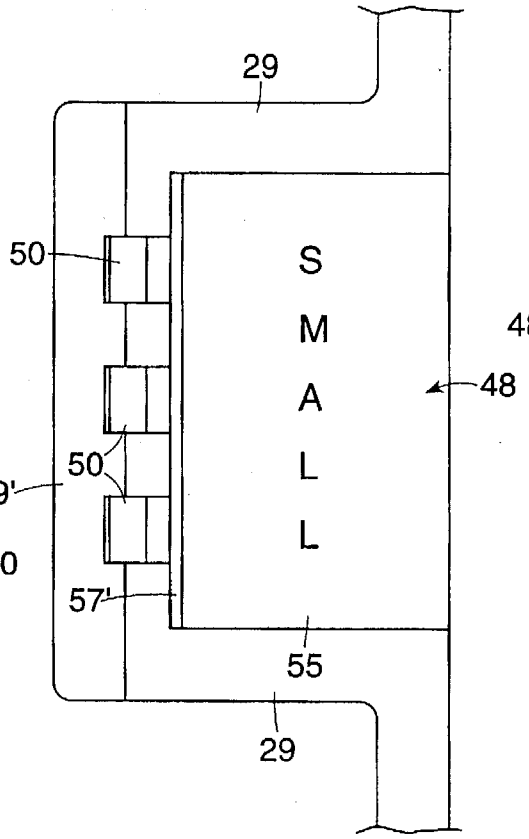
FIG. 10 illustrates a side view of the marker and hanger of FIG. 9.

As shown in FIG. 9, the marker mounting means is provided with a rib 49 and upstanding inwardly directed hook-shaped projections 50 below the rib 49 on opposite sides of a common vertical plane passing through the rib 49. As indicated in FIGS. 10 and 11, a plurality of hook-shaped projections 50 are disposed on each side of the marker mounting means while being disposed in staggered relation to each other longitudinally of the mounting means. For example, one side of the mounting means is provided with three projections (FIG. 10) while the opposite side is provided with four projections (FIG. 11).

The rib 49 may be of any suitable shape particularly since the rib 49 does not need to provide any grooves for interlocking with the marker 48.

As indicated, the mounting means has a flange 29' opposite the rib 49 to define a gap 51 therebetween. The projections 50 extend from opposite sides of the flange 29' and are integral therewith.

The rib 49 is provided with a rounded upper section 52, a pair of sloped side walls 53 and a pair of flat vertical walls 54.

The marker 48 is of U-shaped cross-section and has a pair of depending side walls 55 and a cover 56 which connects the side walls 55 together. Each side wall 55 has a pair of outwardly directed flanges 57, 57' on a lower end to define a recess for engaging with the projections 50 on the respective side of the mounting means. As indicated, the lower flange 57 on each wall 55 has a cam surface 58 for sliding on a chamfered surface 59 on a respective projection 50. The chamfered surfaces 59 of the projections 50 serve to deflect the lower ends of the side walls 55 of the marker 48 inwardly under the rib 47, that is, into the gap 51. This allows the flanges 57 to ride over the projections 50 and to thereafter snap into place under the projections 50. The upper flanges 57' of the walls 55 are disposed over the projections 50 and extend outwardly to the extent of the projections 50 so as to provide smooth continuous surfaces. As indicated, the upper flanges 57' extend outwardly of the lower flanges 57.

As shown in FIG. 9, the side walls 54 of the rib 49 provide a substantial abutment surface against which the walls 55 of the marker 48 abut. Thus, once the flanges 57 have snapped under the projections 50, a firm self-locking relationship is effected between the marker 48 and the projections 50.

In order to remove the marker 48, a special tool (not shown) is provided which can deflect the depending walls 55 inwardly below the rib 49 so that the flanges 57 clear the inner dimensions of the projections 50 thereby permitting the marker 48 to be lifted from the rib 49. Such a tool would have suitable jaws for passing between the projections 50 on each side of the marker 48 (see FIG. 10) so as to engage and push the lower ends of the walls 55 of the marker 48 inwardly.

Figure 12:
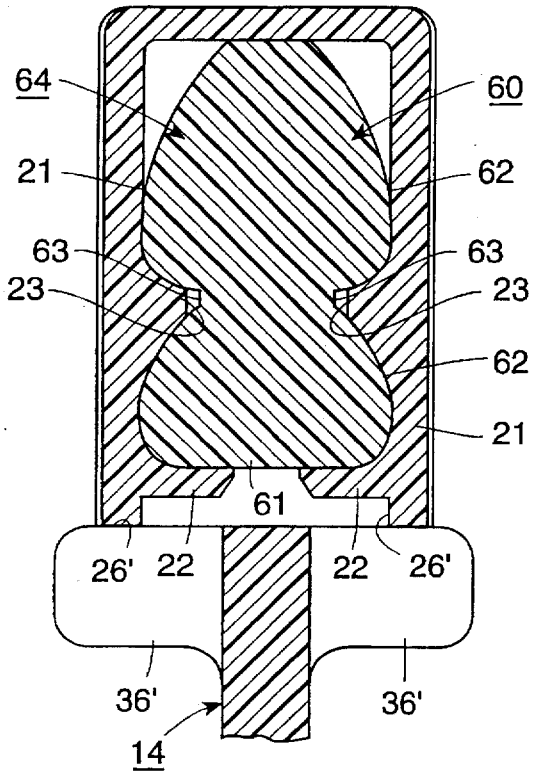
FIG. 12 illustrates a cross-sectional view of a modified hanger and rib construction in accordance with the invention.

Referring to FIG. 12, wherein like reference characters indicate like parts as above, the rib 60 may be provided with a flat top, a flat bottom 61 and a pair of rounded side walls 62 each of which has a pair of curved portions with a longitudinal groove 63 therebetween. Likewise, the marker 64 is provided with a pair of rounded side walls 21, each having a pair of flanges 22, 23 of curvilinear shape to mate with the sides of the rib 59 with the lowermost flange 27 fitting under the rib 60 and the upper flange 23 fitting into the longitudinal groove 63 of the marker 60. As above, the marker 64 has a recess 26' into which the jaws of a suitable tool can be placed for removing the marker. In this respect, the flange 29 is provided with suitable recesses 36' to permit entry of the jaws of the tool.

Figure 13:
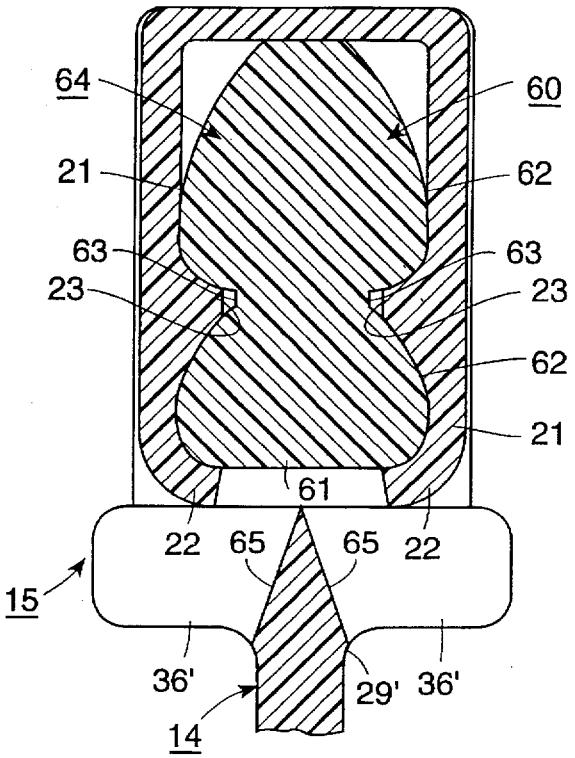
FIG. 13 illustrates a cross-sectional view with a further modified rib and marker construction using curvilinear walls in accordance with the invention.

Referring to FIG. 13 wherein like reference characters indicate like parts as above, the flange 29' of the mounting means may be provided with a pair of recesses 36' which are separated by a wall having sloped surfaces 65 to facilitate entry of the jaws of a special tool under the marker 64. In addition, as indicated, the side wails 21 of the marker 64 are provided with rounded terminal ends to define flanges 22 which fit under the bottom of the rib 59 and intermediate flanges 23 which extend inwardly less than the rounded terminal ends 22.

In this embodiment, the removing tool (not shown) would engage with the lower flanges 22 of the marker 64 in order to splay the side walls 21 outwardly.

Figure 14:
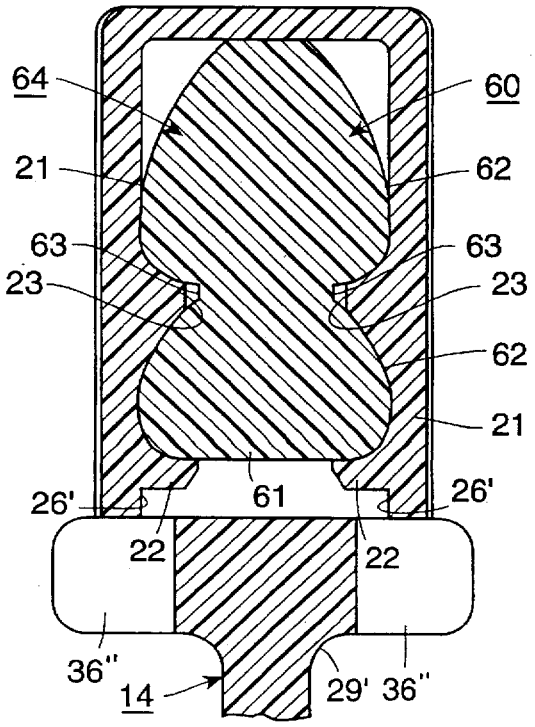
FIG. 14 illustrates a cross-sectional view of a further modification of a marker for use with a rib as shown in FIG. 13 in accordance with the invention.

Referring to FIG. 14, wherein like reference characters indicate like parts as above, the flange 29' of the mounting means may be provided with recesses 36" of reduced size to permit entry of the jaws of a special tool under the walls 21 for removal of the marker 64 from the rib 60.

Figure 15:
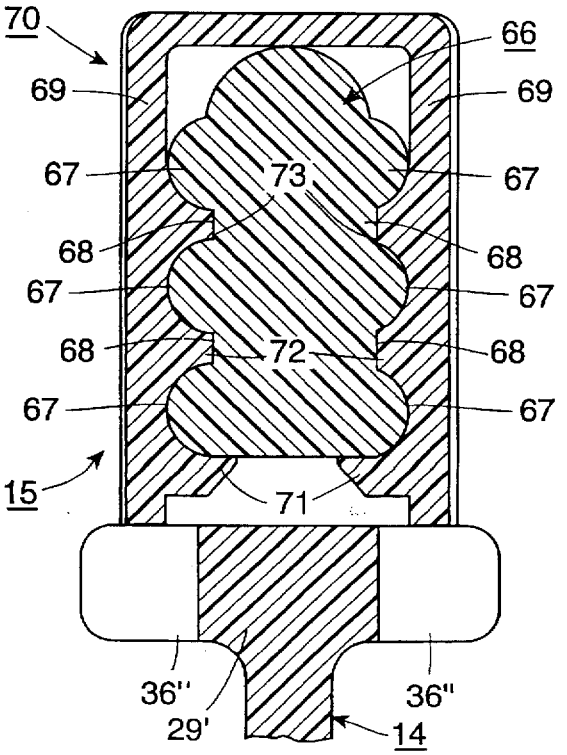
FIG. 15 illustrates a further modified rib and marker construction using curvilinear walls in accordance with the invention.

Referring to FIG. 15, wherein like reference characters indicate like parts as above, the rib 66 of the mounting means 15 may be provided with three longitudinally extending ribs 67 of curvilinear shape, for example of semi-cylindrical shape on each side which define a pair of grooves 68 on each side. In this case, the wall 69 of the marker 70 has three flanges 71, 72, 73. As above, the lowermost flanges 71 fit under the rib 66 while the remaining ribs 72, 73 are matingly received in the grooves 68 defined between the semi-cylindrical ribs 67.

Referring to FIGS. 16 to 20, a marker 74 may be constructed in a different manner for connection to a mounting means 75 on a hanger. In this respect, the marker 74 has a pair of depending parallel walls 76 and a cover 77 connecting the two walls 75 together so as to form a U-shaped cross-section. In addition, the marker 74 has a tab 78 depending from the cover 77 between and parallel to the walls 76 with at least one laterally extending projection 79 thereon.

Figure 17:
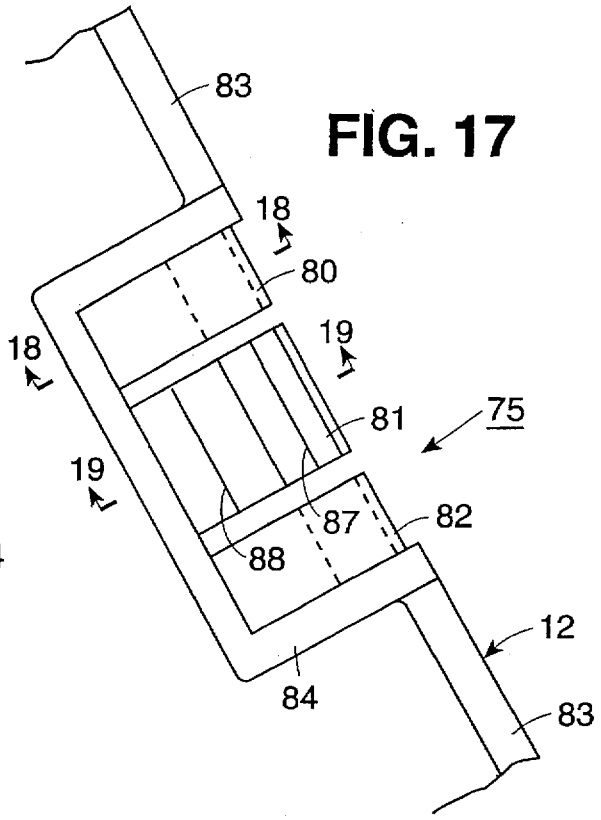
FIG. 17 illustrates a view of the mounting means on the hanger of FIG. 16.
Figure 20:
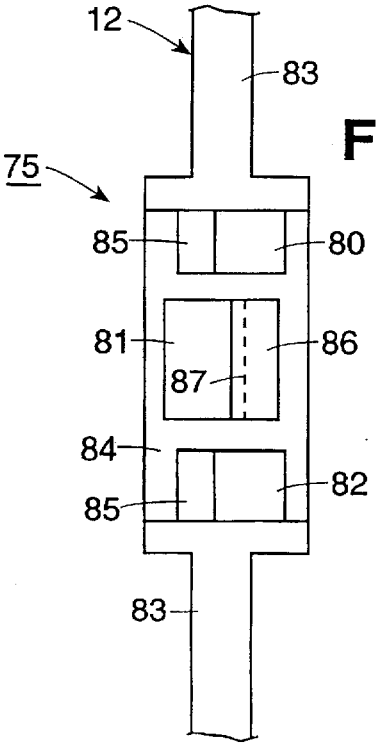
FIG. 20 illustrates a top view of the marker mounting means of the hanger of FIG. 16.

Referring to FIGS. 17 and 20, the mounting means 75 includes a plurality of blocks 80, 81 82 instead of a rib such as described above.

As shown in FIGS. 17 and 20, the mounting means 75, as above, is provided with a flange or bead 83 which is interrupted by a flange 84 which extends in a U-shaped manner (see FIG. 17) to define a recess for receiving the mounting blocks 80, 81, 82.

Figure 18:
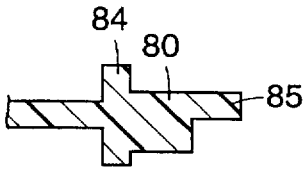
FIG. 18 illustrates a view taken on line 18—18 of FIG. 17 of one upstanding wall of the mounting means thereon.
Figure 19:
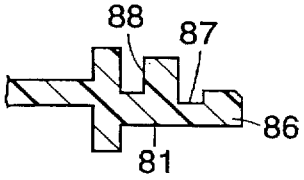
FIG. 19 illustrates a view taken on line 19—19 of FIG. 17 of another upstanding wall of the mounting means in accordance with the invention.

Referring to FIG. 18, each of the end mounting blocks 80, 82 is provided with an upstanding wall 85 having flat side surfaces while the intermediate block 81 (see FIG. 19) is provided with an upstanding wall 86 having a recess 87 in one side. In addition, whereas the end mounting blocks 80, 82 are of generally rectangular shape, the intermediate mounting block 83 has a second recess 88 which opens to the left as viewed. As indicated in FIG. 20, the upstanding walls of the mounting blocks 80, 81, 82 are disposed in spaced relationship to a common plane and in alternating manner on opposite sides of the plane. As indicated in FIG. 16, the plane passes through the depending tab 78 of the marker 74.

Figure 16:
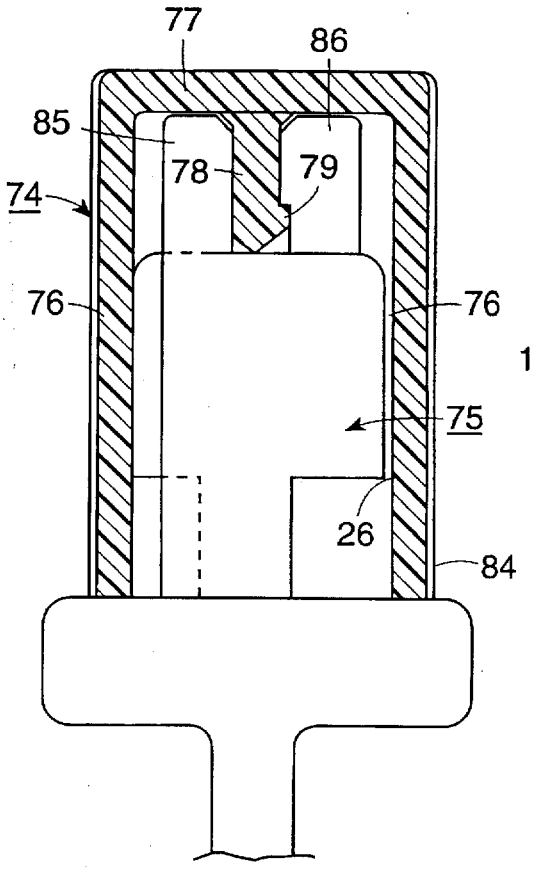
FIG. 16 illustrates a part cross-sectional view of a marker employing an internal tab for engaging with upstanding walls on a hanger in accordance with the invention.

As indicated in FIG. 16, the upstanding walls 85, 86 of the mounting blocks 80, 81, 82 are positioned so that the depending tab 78 of the marker 74 may be passed downwardly between the walls 85, 86 with the projection 79 of the tab 78 snapping into the recess 87 in the upstanding wall 86 of the intermediate mounting block 81.

As indicated in FIG. 20, the mounting blocks 80, 81, 82 are out of line so that the end mounting blocks 80, 82 project beyond the intermediate mounting block 81 on one side, e.g. the right hand side as viewed while the intermediate block 81 projects beyond the end blocks 80, 82 on the opposite side. Thus, when the marker 74 is in place, the end mounting blocks 80, 82 have one side wall each (the right hand side wall, as viewed) which abuts against a side wall 76 of the marker 74 while the opposite wall is spaced slightly from the opposite wall 76 of the marker 74. The intermediate mounting block 81 (the left hand wall, as viewed) abuts against the opposite wall 76 of the marker 74 while the opposite (right hand) wall is slightly spaced from the wall 76 of the marker 74. Thus, the mounting blocks 80, 81, 82 serve to maintain the side walls 76 of the marker 74 in a fixed position. In this respect, the three mounting blocks 80, 81, 82 may deflect the side walls 76 slightly outwardly.

As indicated in FIG. 16, the marker 74 is sized of a width to remain within the plane of the rib 84 of the mounting means 75.

In the embodiment of FIGS. 16 to 20, the marker 74 is mounted in place by pushing the marker 74 downwardly over the mounting blocks 80, 81, 82 so that the walls 76 of the marker 74 receive the mounting blocks 80, 81, 82 therebetween. During this time, the depending tab 78 slides between the upstanding walls 85, 86 of the mounting blocks until the projection 79 thereon snaps into the recess 87 of an upstanding wall 86. At this time, the size marker 74 becomes mounted in a permanent self-locking relation. In this respect, no tool is provided to remove the marker 74.

In order to remove the marker 74, a suitable tool such as an ordinary pair of pliers may be used provided sufficient force is generated to remove the marker. In this respect, the jaws of such a plier are squeezed against the side walls 76 of the marker 74. This causes the central mounting block 81 to deflect relative to the end mounting blocks 80, 82 (see FIG. 20) to the extent that the upstanding wall 86 (FIG. 16) deflects away from the projection 79 on the tabs 78. In this way, the tab 78 is released from engagement with the wall 86. The marker 74 may then be lifted by the pliers from the mounting means 75.

In each of the above described embodiments, the walls and cover of the marker may be provided with indicia to indicate the size of a garment which is suspended from the hanger.

Referring to FIGS. 23 and 24, the tool 90 for removing a marker, such as described above, from a mounting means on a hanger may be molded in one piece of a suitable plastic. As indicated, the tool 90 includes a pair of arms 91 which are mounted on a pivot 92 for pivoting relative to each other between a closed position, as viewed, and an open position. Each arm 91 has a recess 93 at one end to define a rectangular space with the recess 93 of the opposite arm. This rectangular space is of a size to receive a U-shaped marker such as described above. Each arm 91 also has a hook shaped jaw 94 at the terminal end for engaging under a wall of a marker which is received in the space between the jaws 94 when the arms 91 are in the closed position. The tool 90 also has a spring 95 on an opposite side of the pivot 92 from the jaws 94 for biasing the arms 91 into the closed position. As indicated, the spring 95 is integral with the arms 91 and extends in an arcuate manner from the arms 91.

Each arm 91 of the tool 90 has a widened portion 96 to provide a finger gripping portion. In this regard, the tool 90 is sized to be relatively small so as to be manipulated with the fingers in the manner of a staple puller. For example, the overall length of the arms 91 may be 3½ inches. The tool 30 which is described in the embodiment of FIGS. 21 and 22 may be of greater length and, for example may be made of metal so as to be gripped by the hand of a user rather than by the fingers.

The invention thus provides a side marker which can be shipped with a hanger having a garment mounted thereon in a "floor ready" state. The marker and hanger are particular suitable not only for displaying garments on traditional hang-rails but also on the more modern face-out fixtures.

By having the size marker in place on the hanger, a retailer may more readily organize distribution to stores as well as departmental presentation on a selling floor. In addition, by controlling the sizer system on the hangers, a retailer can control the quality and uniformity of the hangers on the selling floor.

In addition, shipment of hangers by manufacturers without the specified markers can be easily detected and rejected thereby insuring control over the garment-on-hanger program.

The embodiments which provide a permanent self-locking fit between the marker and hanger provide a particularly attractive child-resistant arrangement.

What is claimed is:

1. In combination, a hanger having a body for suspending a garment therefrom, a hook for suspending said body from a support, and a marker mounting means located at a juncture between said hanger body and said hook, said mounting means including a rib extending angularly between said hook and said body with a gap disposed under a bottom of said rib, said rib having at least one longitudinal groove in each of two opposite sides thereof; and a size marker mounted in self-locking relation on said rib, said marker including a pair of parallel spaced apart walls receiving said rib therebetween and at least a pair of inwardly directed flanges on each said wall, a lower one of said flanges on each said parallel wall being disposed perpendicularly of said respective wall and slidably disposed under said rib in said gap, and an upper one of said flanges on each said parallel wall being disposed in a respective one of said grooves in said rib.

2. The combination as set forth in claim 1 wherein said size marker has a cover connecting said parallel walls to defining a U-shaped cross-section.

3. The combination as set forth in claim 1 wherein each side of said wall of said rib has a curvilinear contour and each wall of said marker has a curvilinear contour mating with a respective wall of said rib.

4. The combination as set forth in claim 3 wherein said hook includes an angularly extending flange opposite said rib to define said gap therebetween and being of a cross-sectional width wider than said marker.

5. The combination as set forth in claim 4 wherein said flange of said hook has a pair of oppositely disposed recesses extending under said walls of said marker to permit engagement of a tool of predetermined design with said marker walls for removal of said marker from said rib.

6. The combination as set forth in claim 1 wherein said marker mounting means includes a pair of parallel walls having said rib extending therebetween, said marker being of a length to slidably fit between said parallel walls and having a cross-sectional width smaller than each said parallel wall to be recessed therein.

7. The combination as set forth in claim 6 wherein said mounting means further includes a third wall parallel to said rib on an opposite side of said gap and being of larger width than said marker.

8. The combination as set forth in claim 7 wherein said third wall has at least one slot in each side relative to said rib and said marker to define a passage under said marker.

9. The combination as set forth in claim 6 wherein said hanger has a plastic post integral with said body and said hook is made of metal and is received in said post.

10. The combination as set forth in claim 9 wherein said mounting means extends between said post and said hanger body.

11. A hanger having a body for suspending a garment therefrom;

a hook for suspending said body from a support; and a marker mounting means located at a juncture between said hanger body and said hook, said mounting means including a rib extending angularly between said hook and said body with a gap disposed under a bottom of said rib, said rib having at least one longitudinal groove in each of two opposite sides thereof.

12. A hanger as set forth in claim 11 wherein said rib has a pair of said grooves in each said side thereof to receive a pair of inwardly directed flanges of a marker mounted on said rib.

13. A hanger as set forth in claim 11 wherein each side of said rib has a curvilinear contour to receive a wall of a marker having a mating curvilinear contour.

14. A hanger as set forth in claim 11 wherein said mounting means includes a wall opposite said rib to define said gap therebetween and being of a cross-sectional width wider than a marker mounted on said rib.

15. A hanger as set forth in claim 14 wherein said wall has a pair of oppositely disposed recesses for extending under a marker on said rib to permit engagement of a tool of predetermined design with the marker for removal of the marker from said rib.

16. A hanger as set forth in claim 11 wherein said marker mounting means includes a pair of parallel walls having said rib extending therebetween to slidably receive a marker therebetween, said marker having a cross-sectional width smaller than each said parallel wall to be recessed therein.

17. A hanger as set forth in claim 16 wherein said mounting means further includes a third wall parallel to said rib on an opposite side of said gap, said third wall having at least one slot in each side relative to said rib to define a passage under a marker mounted on said rib.

18. A hanger as set forth in claim 16 having a plastic post integral with said body and wherein said hook is made of metal and is received in said post.

19. A hanger as set forth in claim 18 wherein said mounting means extends between said post and said hanger body.

20. In combination, a hanger having a body for suspending a garment therefrom, a hook suspending said body from a support, and a marker mounting means located at a juncture between said hanger body and said hook, said mounting means including a rib extending angularly between said hook and said body with a gap disposed under a bottom of said rib, said rib having at least one longitudinal groove in each of two opposite sides thereof; and a size marker mounted in self-locking relation on said rib, said marker including a pair of parallel spaced apart walls receiving said rib therebetween and at least three inwardly directed flanges on each said wall, a lower one of said flanges on each said parallel wall being disposed in said gap and facing said bottom of said rib, a second flange of said flanges on each said parallel wall being disposed in a respective one of said grooves in said rib; and a third flange of said flanges on each parallel wall facing said rib.

21. The combination as set forth in claim 20 wherein said third flange on each wall of said marker is disposed in parallel between said lower flange and said second flange on said respective wall.

22. The combination as set forth in claim 20 wherein said third flange on each wall of said marker is disposed in parallel above said second flange on said respective wall.

23. The combination as set forth in claim 22 wherein each said third flange has a tapered free end.

24. The combination as set forth in claim 20 wherein said rib has a pair of said grooves in each said side of said wall thereof and each said wall of said marker has said third flange thereof disposed in a respective one of said grooves in said rib.

25. In combination, a hanger having a body for suspending a garment therefrom, a hook for suspending said body from a support, and a marker mounting means located at a juncture between said hanger body and said hook, said mounting means including a rib of predetermined thickness extending angularly between said hook and said body with a single uninterrupted gap disposed under a bottom of said rib, said rib having at least one longitudinal groove in each of two opposite sides thereof; and a size marker mounted in self locking relation on said rib, said marker including a pair of parallel spaced apart walls receiving said rib therebetween and at least a pair of inwardly directed flanges on each said wall, a lower one of said flanges on each said parallel wall being disposed in said gap and facing said bottom of said rib, and an upper one of said flanges on each said parallel wall being disposed in a respective one of said grooves in said rib, said lower ones of said flanges having a spacing therebetween being of a minor fraction of said thickness of said rib.

* * * * *